United States Patent [19]

Hunter

[11] Patent Number: 4,948,052

[45] Date of Patent: Aug. 14, 1990

[54] REVERSIBLE GEAR OSCILLATING SPRINKLER WITH CAM CONTROLLED SHIFT RETAINER

[76] Inventor: Edwin J. Hunter, 5551 Codorniz Rd., Rancho Santa Fe, Calif. 92067

[21] Appl. No.: 335,849

[22] Filed: Apr. 10, 1989

[51] Int. Cl.[5] ..... B05B 3/16

[52] U.S. Cl. ..... 239/242; 74/97 R; 74/527; 239/DIG. 1

[58] Field of Search ..... 239/240, 242, DIG. 1; 74/97, 527

[56] References Cited

U.S. PATENT DOCUMENTS

| | | | |
|---|---|---|---|
| 1,114,680 | 10/1914 | Denhard | 74/97 R |
| 1,492,878 | 5/1924 | Eklundh | 74/97 R |
| 2,902,888 | 9/1959 | Powischill et al. | 74/97 R |
| 3,107,056 | 10/1963 | Hunter | 239/242 |
| 3,645,451 | 2/1972 | Hauser | 239/242 |
| 4,568,024 | 2/1986 | Hunter | 239/242 |
| 4,708,291 | 11/1987 | Grundy | 239/242 |
| 4,718,605 | 1/1988 | Hunter | 239/242 |

*Primary Examiner*—Andres Kashnikow
*Assistant Examiner*—Michael J. Forman
*Attorney, Agent, or Firm*—Baker, Maxham, Jester & Meador

[57] ABSTRACT

A gear driven oscillating sprinkler head includes a reversible gear train for transmitting drive from a drive motor to the oscillating sprinkler head with a shifting mechanism, including a shiftable carrier on which a pair of driving pinions are mounted for shifting alternately into driving engagement with an internal ring gear, with a lost motion connection between a shifting arm and the carrier with a cam controlled shift retainer unit for maintaining the carrier in its engaging position until positively shifted by a shifting arm and over-center springs for biasing and maintaining the shifting arm to the alternate driving engagement positions.

26 Claims, 2 Drawing Sheets

REVERSIBLE GEAR OSCILLATING SPRINKLER WITH CAM CONTROLLED SHIFT RETAINER

BACKGROUND OF THE INVENTION

The present invention relates to sprinkler units and pertains particularly to a special reversible drive gear system for oscillating sprinklers.

In my prior U.S. Pat. No. 3,107,056, issued Oct. 15, 1963, entitled "SPRINKLER", I disclose a gear driven oscillating pop-up type sprinkler. In that patent, the drive train includes a shifting mechanism that alternately shifts a pair of terminal gears carried on a shifting plate or carrier into and out of engagement with an internal gear at the ends of the oscillating stroke. In adapting that drive system to more compact higher pressure, higher volume pop-up sprinklers, certain problems with the shifting mechanism were encountered.

The chief difficulty encountered was the different engaging and shifting forces present in the shifting mechanism. The shifting mechanism has a very strong self-engaging force when turning in the same direction as the input drive. A great deal of force is required to disengage the drive and shift to the opposite direction. This problem was solved in my U.S. Pat. No. 4,568,024, issued Feb. 4, 1986, entitled "OSCILLATING SPRINKLER".

However, a new problem has been discovered, namely when the sprinkler unit is shut off and stops while in the process of shifting from one direction to the opposite direction, the terminal gear becomes disengaged from the ring gear. When the water is again turned on, the drive remains disengaged and will not function. The sprinkler unit is then thought to be defective by the user or consumer and is typically discarded or returned to the vendor for replacement.

It has been discovered that the lost motion connection between the shifting arm and the carrier allows the shifting arm to be biased to a position short of the over-center position, such that the carrier allows the terminal gear to become disengaged. This condition can also occur when the sprinkler head is turned manually to check or adjust the coverage. This problem has been solved to a great extent by a third over-center biasing spring acting on the shift lever as disclosed and claimed in my U.S. Pat. No. 4,718,605 entitled "REVERSIBLE GEAR OSCILLATING SPRINKLER", granted Jan. 12, 1988. However, a simpler and more economical solution is desirable.

It is, therefore, desirable that an improved gear drive be available for sprinkler units that overcomes this problem.

SUMMARY AND OBJECTS OF THE INVENTION

It is, therefore, the primary object of the present invention to provide an improved reversible drive for an oscillating sprinkler unit.

In accordance with the primary aspect of the present invention, an oscillating gear drive train for an oscillating sprinkler head includes a first pinion shiftable into engagement with an internal gear for driving in one direction, and a second pinion shiftable into engagement with the gear for driving in the opposite direction, with first and second pinions mounted on a shiftable carrier and having cam controlled retainer means acting directly on the shiftable carrier for maintaining the first and second pinions in positive drive engagement.

BRIEF DESCRIPTION OF THE DRAWING

The above and other objects and advantages of the present invention will become apparent from the following description when read in conjunction with the drawings wherein.

DETAILED DESCRIPTION OF A PREFERRED EMBODIMENT

Figure 1:
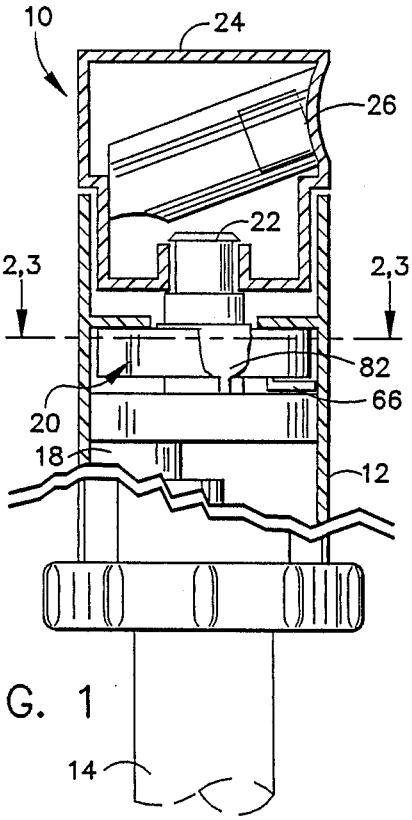
FIG. 1 is a side elevation view partially cut away of a typical sprinkler unit incorporating the gear drive assemblies.

Turning to FIG. 1 of the drawing, a sprinkler unit, designated generally by the numeral 10, includes a generally cylindrical housing 12 having an inlet opening at the bottom, not shown, which is connectable to a source of water under pressure, such as a fixed water line, riser or the like 14. The sprinkler unit includes a typical drive motor 16, such as a water turbine or the like, which is drivingly coupled through a gear train 18, the details of which are not shown, for driving a reversible drive gear train, as will be subsequently disclosed and discussed, which gear train is contained within an oscillating drive unit 20.

The oscillating drive unit 20 is in the form of a generally cylindrical housing mounted in the upper end of the cylindrical housing 12 and is coupled through a hollow or tubular drive shaft 22 to a sprinkler head or nozzle unit 24. The nozzle unit 24 is mounted for rotation with the shaft 22 for rotating in alternate directions about the axis thereof. The shaft 22 is also tubular and serves as a water flow conduit for conveying water to the nozzle unit 24 from the lower portion of the housing.

The basic drive arrangement is substantially like that disclosed in my prior U.S. Pat. No. 3,107,056, issued Oct. 15, 1963, entitled "SPRINKLER"; U.S. Pat. No. 4,568,024, issued Feb. 4, 1986, entitled "OSCILLATING SPRINKLER"; and U.S. Pat. No. 4,718,605 entitled "REVERSIBLE GEAR OSCILLATING SPRINKLER", granted Jan. 12, 1988. The full disclosure and contents of these three patents are incorporated herein by reference as though fully set forth.

Figure 2:
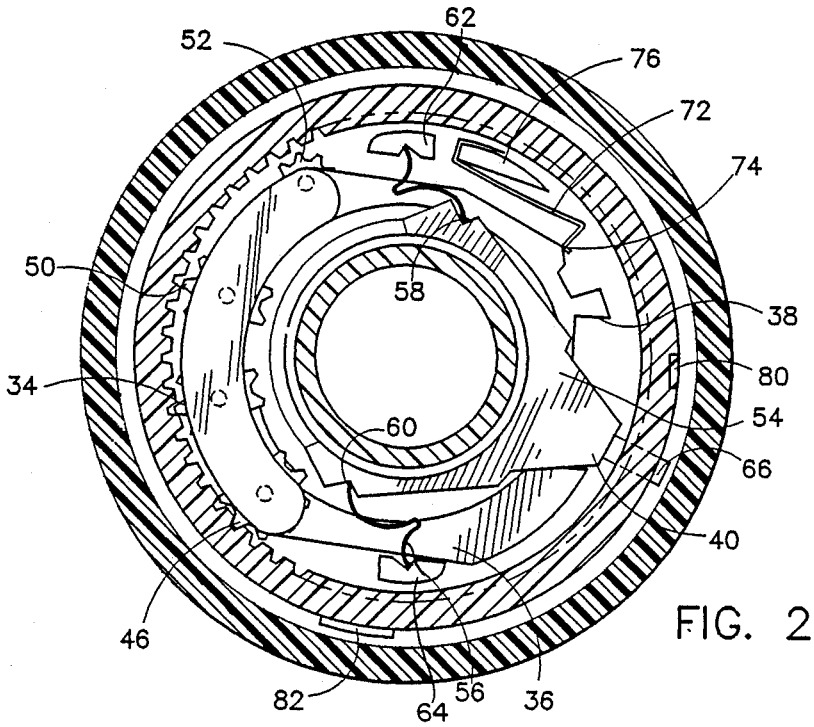
FIG. 2 is an enlarged sectional view taken on line 2—2 of FIG. 1.
Figure 3:
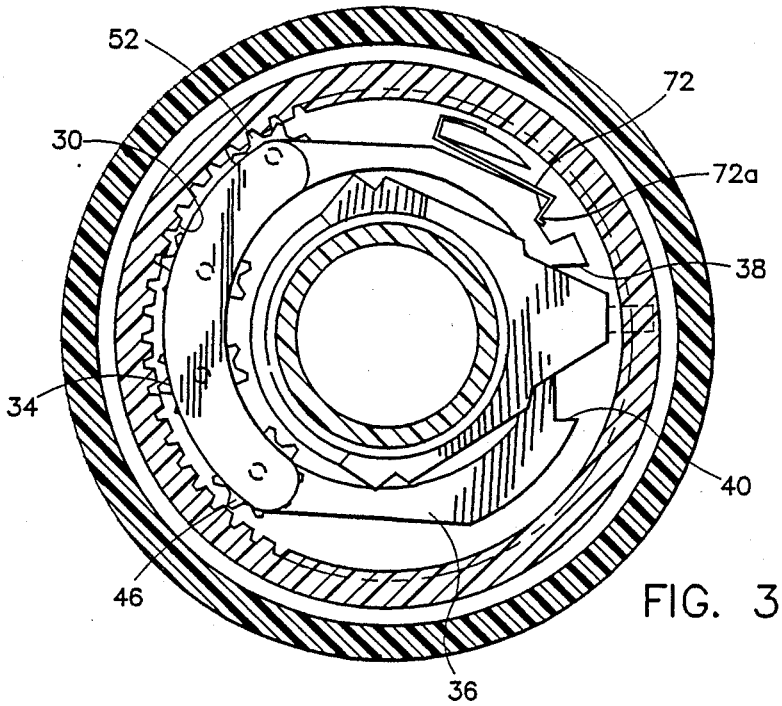
FIG. 3 is a sectional view like FIG. 2, with the drive direction reversed.
Figure 4:
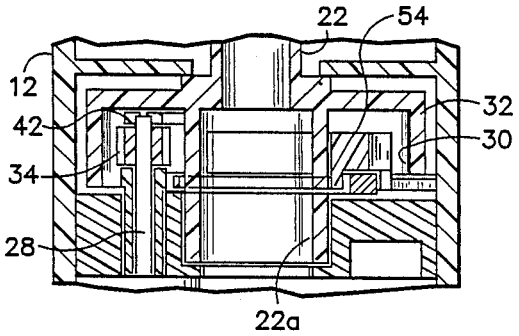
FIG. 4 is a sectional view taken on line 4—4 of FIG. 3.

The oscillating head 24 is driven in alternate directions by a reversible drive assembly, which is best illustrated in FIGS. 2–4. The drive assembly comprises a reversible gear train and includes an input shaft 28, which is driven by a suitable motor or turbine 16 powered by the water flowing through the unit. The shaft 28 is mounted for rotation about an axis positioned parallel and to one side of the central axis of the rotatable member 22. The input shaft 28 carries an input pinion gear 34 positioned between the central axis, and an internal gear 30 formed on the downwardly turned or extending skirt portion 32 of the output drive unit 20. The input pinion gear 34 is mounted on the shaft 28 for rotating therewith and for driving a pair of shiftable gear trains that alternately shift into driving engagement with the internal gear 30, as will be described.

The shifting gear trains comprise a pivoting yoke or carrier, including a lower annular plate 36, which surrounds the central drive shaft 22 and is pivotally mounted on the shaft 28 for pivotal movement about the axis thereof. The shiftable yoke plate 36 mounts or carries the gear train, which includes a pair of oppositely driven terminal gears 46 and 52, which are driven by the input pinion 34 by way of one or more idler gears as needed. The yoke assembly includes an upper plate 42, between which is mounted a first gear train, comprising an idler gear 44 driven by the input gear 38' and an outer or terminal pinion gear 46 for drivingly engaging the internal gear 30 for driving it in a counterclockwise direction.

A second gear train includes a first idler gear 48 driven by the input gear 38, drivingly engaging a second idler gear 50, which drives a terminal gear 52, which in turn drivingly engages the internal ring gear 30 for driving the ring gear in the clockwise direction, as seen in FIG. 2. The yoke assembly, including the plate 36, pivots about the axis of shaft 28 for pivoting to alternate positions, as shown respectively in FIGS. 2 and 3, for alternately shifting the terminal gears of the drive trains selectively into driving engagement, with the internal ring gear 30 for driving the ring gear and the sprinkler head in alternate directions. The yoke or carrier 36 is shifted between the alternate driving positions by a shifting lever 54, which is shifted by shoulders or fingers 80 and 82 carried on the ring gear 30, and projecting downward to engage a tip 66 of lever 54.

As shown in FIG. 2, the first gear train, including idler gear 44 and terminal drive gear 46, are in driving engagement with the internal ring gear 30, such that the ring gear is driven by the gear 46 in a counterclockwise direction.

Referring to FIG. 3, the shifting yoke 36 has been tilted in the opposite direction, such that the terminal drive gear 52 is in driving engagement with the internal ring gear 30 for driving the ring gear in the clockwise direction, with the input gear 34 being driven in the counterclockwise direction, as shown in FIG. 2.

The shifting yoke 36 is pivoted about the axis of shaft 28 by means of a shifting lever 54, which is rotatably mounted on the lower tubular extension **22*a* of the shaft 22. The shifting lever 54 is connected to the yoke by a lost-motion connection comprising a downward extension portion thereof to finger or arm 66, which alternately engages shoulders 38 and 40 of the yoke. The shifting lever 54 is biased to its alternate positions by a pair of identical over-center springs 56, engaging notches 58 and 60 on opposite sides of the lever 54, and engaging notches 62 and 64 on extensions of the housing 12**.

The lever 54 is shifted by the ring gear 30, by the engagement of the outer tip 66 of the lever 54 by opposing fingers or shoulders 80 and 82 on the output member 32 for shifting it about its axis. This shifts it against the over-center springs 56, which forces the lever 54 to engage shoulders 38 and 40 of the yoke, forcing yoke 36 to pivot about its axis 28. This shifts alternate ones of the gears 46 and 52 into driving engagement with the internal ring gear 30. The shoulders 80 and 82 may be formed directly on member 32 or can be downwardly depending fingers carried on the member 32. One of the fingers 82 is preferably an adjustable arm journaled to adjust the position of finger 82 and the arc of coverage.

Figure 5:
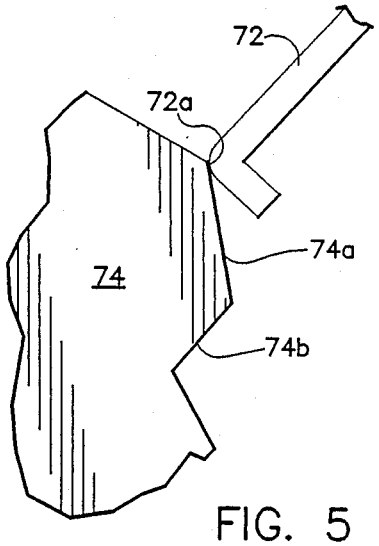
FIG. 5 is an enlarged detailed view of the cam and spring detent.

A cam controlled engagement retaining device (cam controlled detent) includes a biasing spring 72 in biasing engagement, with a dual faced cam 74 on yoke 36, and is mounted on a peg 76 on a stationary housing portion 78, for providing a positive biasing of the yoke 36 to its extreme positions independently of the biasing of the shifting lever 54. The biasing spring 72 has a generally L-configuration with a cam follower tip **72*a*, which engages and slides along opposite faces 74*a* and 74*b* of the cam 74 for biasing and retaining the yoke 36 into alternate ones of the driving engagement positions, as shown in FIGS. 2, 3 and 5**.

The cam 74 is preferably symmetrical and generally V-shaped so that tip **72*a* biases against a respective face for biasing the yoke in the respective direction. This arrangement functions somewhat as a detent and maintains the terminal gears positively biased to the engaging position independently of the shifting lever 54. Thus, if the water should be cut off as the ring gear 30 is moving the shifting lever 54 to the over-center position, the terminal gear 46 or 52 will remain engaged under the positive bias of the cam biasing spring 72. When the water is again turned on, the drive will still be engaged and continue to drive internal gear 30, which will continue to shift lever 54** and the carrier to the alternate position. This eliminates the problem of the unit stalling in an intermediate shifting position between alternate drive positions.

The shift engagement retaining apparatus acts as a combination cam and detent mechanism. The opposite sides **74*a* and 74*b* of the cam 74 act as detent recesses for receiving the pawl like tip 72*a* of the spring 72. While detent recesses would function to hold the carrier in the respective shifted positions, the cam surfaces have advantages. For example, the cam surfaces provide for a flexible or resilient bias of the carrier to the respective drive engagement position. While the cam 74 and spring 72** are shown as on one side of the carrier, it may be located at any suitable place on the carrier yoke. However, it is preferably located as far away from the pivot axis of the carrier as possible, i.e. on the opposite side of the center axis of the housing.

At the position, as shown in FIG. 2, the lever 54 has been forced over-center in a clockwise direction under engagement by shoulder 86 of the ring gear, thereby engaging shoulder 40 or yoke 36, and shifting the yoke 36 to shift gear 52 out and gear 46 into driving engagement with the ring gear 30. The ring gear 30 begins to turn in the counterclockwise direction until shoulder 82 thereof engages the lever tip 66 of lever 54, shifting it back in the counterclockwise direction, as shown in FIG. 3. This shifts the gear 46 out of engagement with the ring gear, and the gear 52 back into driving engagement. Continued rotation of the input gear 34 then immediately reverses direction of the ring gear 30, forcing it to begin rotating in the clockwise direction again.

The stroke of the drive and the angle of coverage of the resulting output will be determined by the angle or the length of the slot or space between actuating shoulders 68 and 70 on the ring gear. At least one of these shoulders is preferably moveable or adjustable in position relative to the other to adjust the arc covered by the sprinkler unit. The shoulder is preferably on an arm that is adjustably (rotatable) mounted on the output drum 32, and can be shifted toward and away from the other finger or shoulder.

Thus, while I have illustrated and described my invention by means of specific embodiments, it is to be understood that numerous changes and modifications may be made therein without departing from the spirit and scope of the invention as defined in the appended claims.

I claim:

1. An oscillating sprinkler unit, comprising:

a sprinkler head mounted for rotation about a first axis;

drive means comprising a carrier and alternately operable terminal gear means on said carrier and shiftable with said carrier to alternately engageable driving positions within said drive means for driving said sprinkler head in alternate directions;

shifting arm means pivotally moveable between alternate shifting positions by shoulder means carried by said drive means for shifting said carrier between said alternately engageable positions; and cam means on said carrier, and follower means slideably engaging said cam means for biasing and retaining said carrier in a selected one of said alternately engageable positions until shifted therefrom by said shifting arm means.

2. The sprinkler unit of claim 1 wherein said cam means comprises a cam lobe and said follower means engages said lobe on opposite sides thereof for biasing and retaining said carrier in a selected one of said alternately engageable positions.

3. The sprinkler of claim 2 wherein said spring biased follower means comprises a generally L-shaped leaf spring.

4. The sprinkler of claim 3 wherein said cam lobe is on said carrier and said spring biased follower means is mounted on adjacent housing structure.

5. The sprinkler of claim 4 wherein said cam lobe is of a substantially symmetrical V-shape; and said spring biased follower means comprises a generally L-shaped leaf spring.

6. The sprinkler of claim 2 wherein said cam lobe is on said carrier and said spring biased follower means is mounted on adjacent housing structure.

7. The sprinkler of claim 6 wherein:

drive means comprises a drive gear driven by a drive motor and mounted for rotation about a second axis spaced from said first axis;

said carrier is mounted for pivotal movement about said second axis; and said shifting arm means is mounted for pivotal movement about said first axis.

8. The sprinkler unit of claim 7 wherein:

said carrier comprises a yoke surrounding said first axis and said shifting arm means engages said carrier through lost motion means comprising shoulder means on the opposite side of said first axis from said second axis.

9. The sprinkler of claim 2 wherein said cam lobe is of a substantially symmetrical V-shape; and said spring biased follower means comprises a generally L-shaped leaf spring.

10. The sprinkler of claim 1 wherein:

drive means comprises a drive gear driven by a drive motor and mounted for rotation about a second axis spaced from said first axis;

said carrier is mounted for pivotal movement about said second axis; and said shifting arm means is mounted for pivotal movement about said first axis.

11. The sprinkler unit of claim 1 wherein:

said carrier comprises a yoke surrounding said first axis and said shifting arm means engages said carrier through lost motion means comprising shoulder means on the opposite side of said first axis from said second axis.

12. An oscillating sprinkler unit, comprising:

a sprinkler head mounted for rotation about a first axis;

a drive motor;

a reversible gear train for drivingly connecting said drive motor to said sprinkler head for driving said sprinkler head in alternate directions, comprising a final drive gear connected to said sprinkler head, shiftable drive means comprising a carrier and alternately operable terminal gear means on said carrier shiftable with said carrier to alternately engageable positions with said final drive gear for driving said sprinkler head in alternate directions;

shifting arm means pivotally mounted adjacent said carrier and moveable between alternate shifting positions by engagement with shoulder means carried by said gear train, and lost motion means for connecting said shifting arm means with said carrier for shifting said carrier between said alternately engageable positions upon movement of said shifting arm means between said alternate shifting positions; and cam means on said carrier slideably engageable by adjacent biasing follower means for biasing and maintaining said carrier in a selected one of said alternately engageable positions until shifted therefrom by said shifting arm means.

13. The sprinkler unit of claim 12 wherein said cam means comprises a cam lobe and said adjacent biasing follower means comprises spring biased follower means engaging said lobe on opposite sides thereof.

14. The sprinkler of claim 13 wherein said spring biased follower means comprises a generally L-shaped leaf spring.

15. The sprinkler of claim 14 wherein said cam lobe is on said carrier and said L-shaped leaf spring biased is mounted on adjacent housing structure.

16. The sprinkler of claim 13 wherein said cam lobe is on said carrier and said spring biased follower means is mounted on adjacent housing structure.

17. The sprinkler of claim 13 wherein said cam lobe is of a substantially symmetrical V-shape; and said spring biased follower means comprises a generally L-shaped leaf spring.

18. The sprinkler of claim 17 wherein:

reversible gear train comprises a drive gear driven by said drive motor and mounted for rotation about a second axis spaced from said first axis;

said carrier is mounted for pivotal movement about said second axis; and said shifting arm means is mounted for pivotal movement about said first axis.

19. The sprinkler unit of claim 18 wherein:

said carrier comprises a yoke surrounding said first axis and said shifting arm means engages said carrier through said lost motion means comprising shoulder means on the opposite side of said first axis from said second axis.

20. The sprinkler of claim 12 wherein:

said reversible gear train comprises a drive gear driven by said drive motor and mounted for rotation about a second axis spaced from said first axis;

said carrier is mounted for pivotal movement about said second axis; and said shifting arm means is mounted for pivotal movement about said first axis.

21. The sprinkler unit of claim 12 wherein:

said carrier comprises a yoke surrounding said first axis and said shifting arm means engages said carrier through said lost motion means comprising shoulder means on the opposite side of said first axis from said second axis.

22. The sprinkler of claim 21 wherein said cam lobe is of a substantially symmetrical V-shape; and said spring biased follower means comprises a generally L-shaped leaf spring.

23. An oscillating sprinkler unit, comprising:

a housing having a generally cylindrical configuration with a central axis, an inlet at a lower end for attachment to a source of water and an outlet at an upper end;

a sprinkler head mounted at said upper end for rotation about said central axis;

a drive motor mounted in said housing for driving said sprinkler head;

a shiftable gear train comprising terminal drive gear means including an internal gear connected to said sprinkler head, shiftable means for alternatively shifting said terminal drive gear means alternatively into engagement with said internal gear for driving said sprinkler head in alternate directions;

said shiftable drive means comprising a drive shaft driven by said drive motor and operatively connected to a drive gear mounted for rotation about a second axis offset from said first axis;

a pivoting carrier mounted for pivotal movement about said second axis;

one of said terminal gear means mounted on said carrier on one side of said second axis, and the other of said drive gears mounted on said carrier on the other side of said second axis;

a shifting arm mounted adjacent said carrier for pivotal movement about said first axis;

lost motion means disposed between said shifting arm and said carrier for connecting said shifting arm to said carrier for shifting said terminal drive gear means to alternately engageable positions;

first over-center biasing means for maintaining said shifting arm means in a selected one of said alternately shifting positions; and over-center cam means on said carrier slideably engageable by adjacent spring biased follower means for biasing and maintaining said carrier in a selected one of said alternate engageable positions.

24. A sprinkler unit according to claim 23 wherein:

said over-center cam means comprises a dual faced cam and said follower means comprises a generally L-shaped spring disposed between said carrier and said housing for biasing said shifting arm to said one of said alternately shifting positions.

25. The sprinkler of claim 24 wherein said dual faced cam is on said carrier and said spring is mounted on adjacent housing structure.

26. The sprinkler of claim 25 wherein said cam has a lobe that is of a substantially symmetrical V-shape; and said spring comprises a generally L-shaped leaf spring.

* * * * *